US006361021B1

(12) United States Patent
Brennan

(10) Patent No.: US 6,361,021 B1
(45) Date of Patent: Mar. 26, 2002

(54) POWER DRIVEN FISH TAPE

(76) Inventor: Bob Brennan, 6082 St. Rte. 128, Miamitown, OH (US) 45041

( * ) Notice: Subject to any disclaimer, the term of this patent is extended or adjusted under 35 U.S.C. 154(b) by 0 days.

(21) Appl. No.: 09/552,775

(22) Filed: Apr. 20, 2000

(51) Int. Cl.[7] ..... B65H 57/28
(52) U.S. Cl. ..... 254/134.3 FT
(58) Field of Search ..... 254/134.3 FT, 254/134.3 R

(56) References Cited

U.S. PATENT DOCUMENTS

| | | | | |
|---|---|---|---|---|
| 1,956,806 A | | 5/1934 | Mitzen et al. | |
| 2,718,376 A | | 9/1955 | Raney | |
| 2,743,884 A | * | 5/1956 | Briggs | 254/134.3 FT |
| 2,896,911 A | | 7/1959 | Carpenter | |
| 3,070,355 A | | 12/1962 | Wyatt | |
| 3,145,972 A | | 8/1964 | Sweeney | |
| 3,232,555 A | | 2/1966 | Gorrell et al. | |
| 3,528,644 A | * | 9/1970 | Scott | 254/134.3 FT |
| 3,533,599 A | * | 10/1970 | Hindenburg | 254/134.3 FT |
| 3,549,127 A | * | 12/1970 | Niemann | 254/134.3 FT |
| 4,290,584 A | | 9/1981 | Eckels et al. | |
| 4,413,808 A | | 11/1983 | Finkle | |
| 4,458,880 A | | 7/1984 | Conti | |
| 4,497,470 A | | 2/1985 | Carter et al. | |
| 4,728,079 A | | 3/1988 | Nitta et al. | |
| 4,917,362 A | | 4/1990 | Wilson | |
| 4,951,890 A | | 8/1990 | Sossamon | |
| 4,956,889 A | | 9/1990 | Kirk | |
| 5,071,085 A | | 12/1991 | Beers | |
| 5,190,237 A | | 3/1993 | Fagan | |
| 5,277,350 A | | 1/1994 | Thornbury, Jr. | |
| 5,376,035 A | | 12/1994 | Forrest | |
| 5,464,193 A | | 11/1995 | Wrate | |
| 5,505,432 A | * | 4/1996 | Noonan | 254/134.3 FT |
| 5,588,613 A | | 12/1996 | Nagy | |
| 5,984,273 A | | 11/1999 | Ray | |

* cited by examiner

*Primary Examiner*—Robert C. Watson
(74) *Attorney, Agent, or Firm*—Wood, Herron & Evans, LLP

(57) ABSTRACT

A power driven fish tape includes a handle and a spool. The handle rides along the peripheral surface of the spool and feeds a metal strip fish line into or out of the spool. The handle includes a first gear which drives a second gear on the spool. The drive gear can be attached to a portable drill which permits the fish tape to be fed or rewound using the power drill.

7 Claims, 3 Drawing Sheets

POWER DRIVEN FISH TAPE

BACKGROUND

A fish tape is used by electricians to pull wire through confined spaces. It can be used when a house is being rewired or for running wire through conduit. Fish tape is a long narrow metal strip which is wound on a spool. The spool completely encases the wire strip. Generally there is a handle which acts as a feeding mechanism which rides on the exterior of the spool.

The top of the spool has a circumferential opening which allows the metal strip to be pulled out. The metal strip also runs through an opening in the handle. Thus as the handle rotates around the spool, it either feeds or rewinds the metal strip.

The metal strip can be 100 to 200 feet in length. Thus, it is quite an effort to feed such a long length of metal strip through conduit and it is very time consuming to rewind the strip. There are several different power driven devices which feed and unwind fish tape. Motorized devices such as disclosed in Raney, U.S. Pat. No. 2,718,376 and Sweeney, U.S. Pat. No. 3,145,972 are basically dedicated devices which do not provide the flexibility of a hand operated fish line. Certain devices are designed to attach to fish lines such as those disclosed in Finkel, U.S. Pat. No. 4,413,808, Wilson, U.S. Pat. No. 4,917,362, and Nagy, U.S. Pat. No. 5,588,613. However these devices take a large amount of time to attach the fish tape to the power source and basically are unsuitable for every day use by an electrician.

SUMMARY OF THE INVENTION

The present invention is premised on the realization that a powered fish line can be provided wherein the power source is a separate power drill preferably a battery operated drill which can quickly attach and detach from the device. Further the present invention is premised on the realization that such a power driven fish line can also be used without a power drill, thus providing the electrician with the flexibility of feeding and retracting the fish line manually.

The fish line of the present invention includes a spool which holds the metal strip. The spool has an outer casing and an annular gear fixed to one side of the casing. The fish line further includes a handle which operates as a feed element through which the metal strip is fed and retracted. This feed element or handle rides on the exterior of the spool and includes a drive gear which engages the gear on the spool. Thus to operate the fish line one simply attaches an electric drill to the drive of the drive gear causing it to rotate thereby causing the spool to rotate relative to the handle, feeding or retracting the fish tape. If the electrician so chooses, he can use the fish tape by hand by simply grasping the handle and rotating the spool. This provides a very simple mechanism to feed and retract fish lines. It does not significantly increase the overall mass of the standard fish line and allows the electrician to either use the power source or operate it manually as the circumstances dictate.

The invention will be further appreciated in light of the following detailed description and drawings in which:

DETAILED DESCRIPTION

Figure 1:
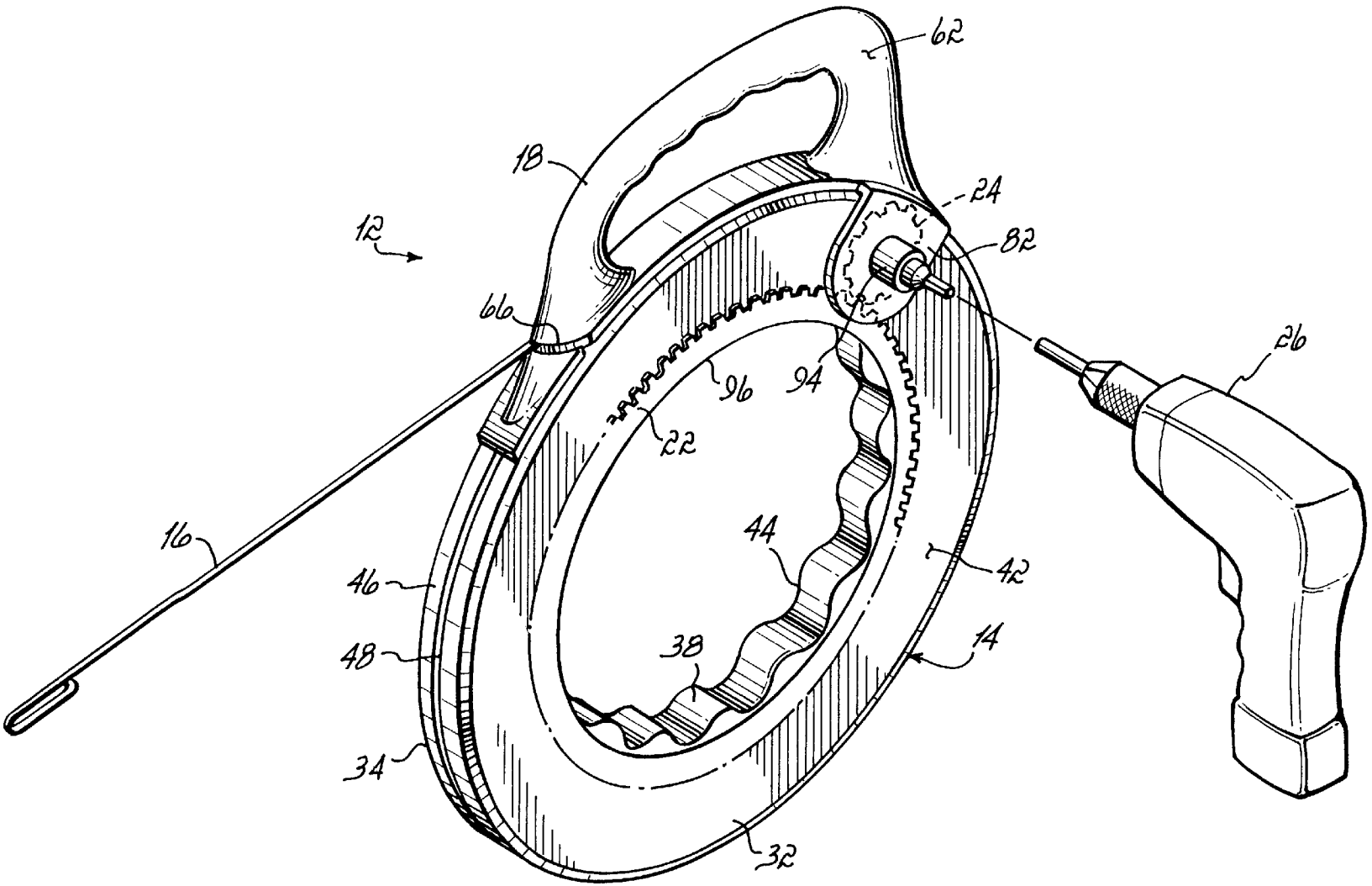
FIG. 1 is a perspective view of the present invention.
Figure 2:
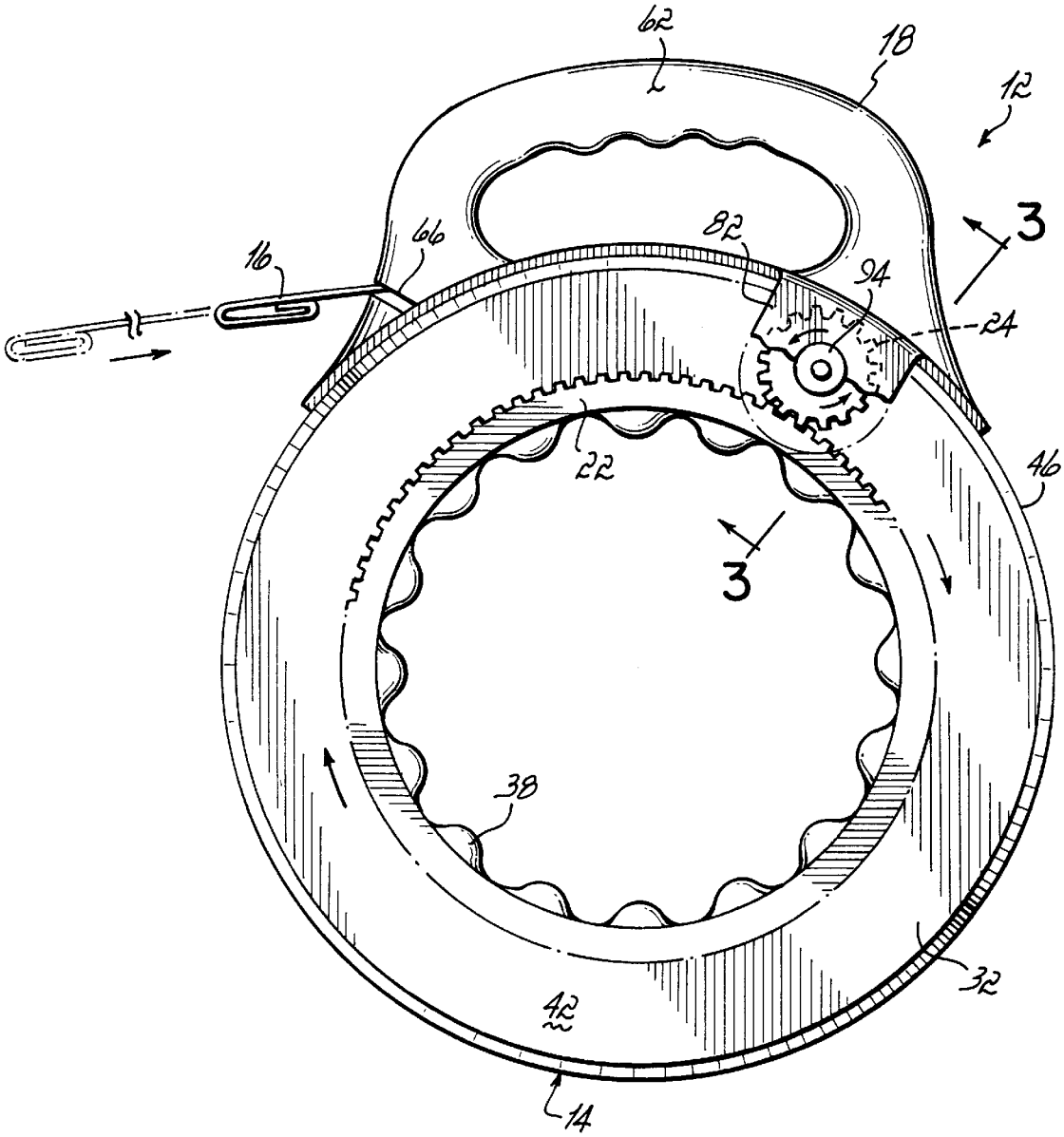
FIG. 2 is a side view of the fish tape of the present invention.

The present invention is a fish tape 12 which includes a spool 14 which holds an elongated narrow metal strip 16. The metal strip can generally be up to 200 to 250 feet in length. The fish tape 12 further includes a handle 18 which assists in feeding the strip from the spool 14.

As shown in FIGS. 1–4, the fish tape of the present invention is driven by a portable drill 26. The spool itself includes a first gear 22 which is operated by a drive gear 24 which in turn is rotated by the portable drill 26.

The spool 14 is formed from a first half 32 and a second half 34 held together by bolts (not shown). The spool has an inner surface 38 which has a wave-like configuration which assists the individual in grasping the spool 14 when the metal strip 16 is fed from or rewound into the spool 14.

Spool 14 further includes a first side wall 42, a second side wall 44, and a top annular wall 46. The top annular wall is split by a seam 48 which as described below permits the metal strip 16 to be fed from and rewound into the inner portion 36 of the spool 14.

Figure 3:
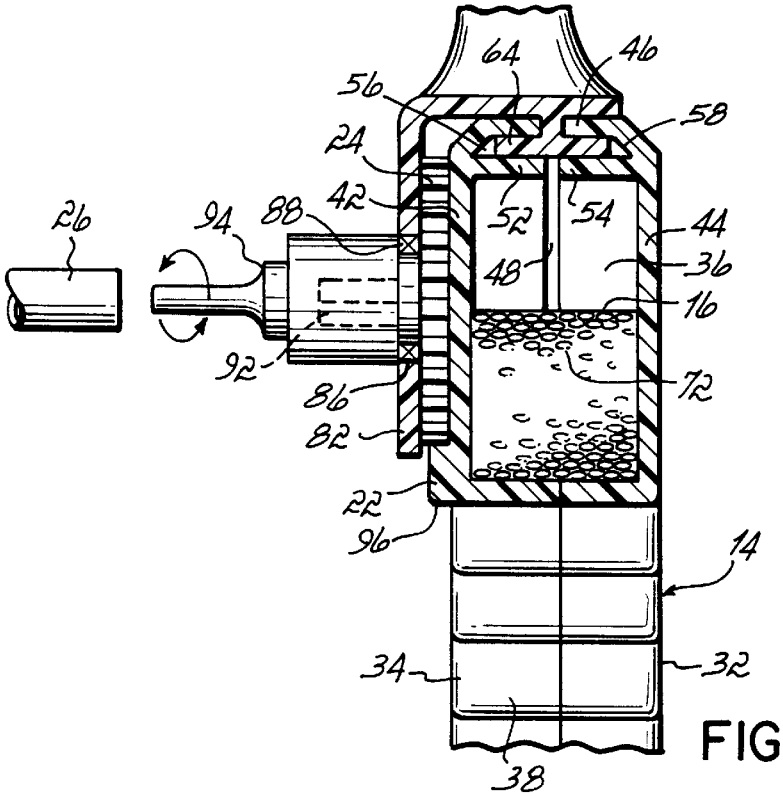
FIG. 3 is a cross-sectional view taken at lines 3—3 of FIG. 2.

As shown more particularly in FIG. 3, the first and second 20 halves 32 and 34 of the spool 14 also include inner ledges 52 and 54 respectively which provides a mirror image channels 56 and 58 between ledges 52 and 54 and the top wall 46 of the spool. In turn the handle 18 includes an exterior handle portion 62 connected to a slide member 64 which rides in channels 56 and 58. The handle is provided with a path 66 through which the metal strip 16 passes.

The handle 18 further includes a rigid plastic ear 82 which extends from the handle along side the first side wall 42 of spool 14. Ear 82 includes a hole 86 lined with a bushing 88. A drive shaft 92 extends through the bushing 88 and is fixed to drive gear 24. The drive 92 is preferably a half inch rectangular drive which is adapted to connect to a half inch drive socket 94 which is in turn attached to a portable drill 46. Optionally the drive can be adapted to fit directly into the drill or into any other type of connector as desired.

The first gear 22 is molded as part of the first side wall 42 and includes a bottom edge 96 which generally corresponds to the inside annular wall 38 of spool 14.

The fish tape 12 can be used either manually or can be driven by a portable drill. For manual operation the handle 18 is simply grasped with one hand. The user's second hand then grabs the spool 14 with his fingers wrapped around the bottom wall 38. By rotating the spool relative to the handle, the coiled metal strip 72 will likewise be rotated relative to the handle which will cause the metal strip 16 to be fed from the spool or pulled back into the spool depending on the direction of rotation of the spool relative to the handle.

The fish tape can also be operated very simply by using an electric drill which is attached to drive 92. Again the user would hold the fish tape handle 18, the user would then operate the drill 26. When the drill moved forward, it would drive the drive gear 24 which in turn would drive first gear 22 moving the spool 14 relative to the handle 18. This would pull the fish tape back into the spool. When the drill was operated in the opposite direction, it would cause the spool to rotate relative to the handle and force the metal strip out from the spool.

Figure 4:
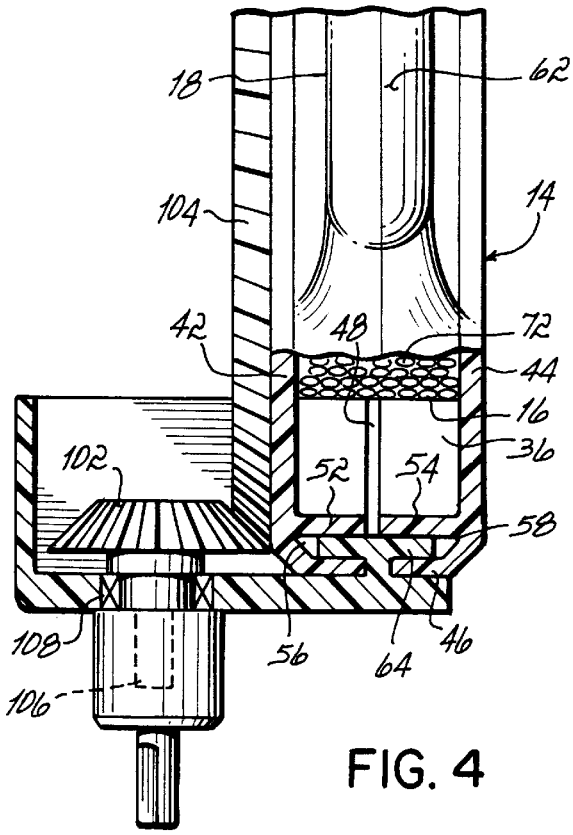
FIG. 4 is a top view partially in cross-section showing the drive mechanism of an alternate embodiment of the present invention.

FIG. 4 shows an alternate embodiment of the present invention. The drive gear 102 is a beveled gear and the gear

104 attached to the side wall of the spool is likewise a beveled gear. This mechanism likewise includes a drive member 106 which extends through a bushing 108 residing in a hole in a housing 112 which extends from the handle 18. This will permit an orientation of the drill to be in line with the direction of movement of the fish tape.

The gear mechanism of the present invention can also be replaced with a chain drive mechanism. The bevel gear 102 shown in FIG. 4 could be replaced or a rubber drive member which would run against the side wall of the spool causing it to rotate. The spool wall would act as a second drive member. Basically any drive mechanism that can be attached to a drill can be used to replace the gear drive mechanism as shown in FIGS. 3 and 4.

Thus, the fish tape of the present invention can be used in the same manner as current fish tapes, manually feeding and rewinding the wire from the spool. Further it can be operated by a portable electric drill. The mechanism that provides the drive does not interfere with the manual feeding of the fish tape. Further connecting and disconnecting the power tool is quick and easy. This provides maximum flexibility to an electrician.

This has been a description of the present invention along with the preferred method of practicing the invention.

However, the invention itself should be defined by the appended claims wherein we claim:

1. A fish tape for pulling wire comprising:

a length of metal strip wrapped around a spool said spool having a first side wall and a second side wall;

a feed element having a handle and being attached to an exterior portion of said spool between said first and second side walls and adapted to rotate relative to said spool wherein said metal strip extends through said feed element;

a first drive member fixed to said feed element; a second drive member fixed to said spool and engaging said first drive member;

a drive affixed to said first drive member and adapted to rotate said first and second drive members said drive further adapted to attach to a portable drill;

whereby rotation of said drive rotates said spool relative to said feed element forcing said metal strip either from said spool or pulling said metal strip back into said spool.

2. The fish tape claimed in claim 1 wherein said first drive member and said second drive member are first and second intermeshing gears.

3. The fish tape claimed in claim 2 wherein said feed element includes an ear which extends over a side wall of said spool and wherein said first gear is fixed to said ear and said ear acts as a guard around an area where said first gear engages said second gear.

4. The fish tape claimed in claim 1 wherein said first gear and said second gear are beveled gears.

5. The fish tape claimed in claim 2 wherein said second gear is integral with said spool.

6. A fish tape comprises a spool and an elongated metal strip would around said spool;

a handle riding on an outer surface of said spool said strip extended through said handle;

said handle having a portion extended over a side wall of said spool;

a drive gear rotably motivated to said portion and contacting a second gear fixed to said side wall of said spool whereby rotation of said drive gear causes said spool to move relative to said handle thereby feeding or rewinding said metal strip from said spool.

7. A fish tape for pulling wire comprising a length of metal strip wrapped around a spool said spool having a first side wall and a second side wall;

a feed element having a handle and being attached to an exterior portion of said spool between said first and second side walls and adapted to rotate relative to said spool wherein said metal strip extends through said feed element;

a first drive member fixed to said feed element;

a second drive member fixed to said spool and engaging said first drive member wherein said first drive member and said second drive member are first and second intermeshing gears;

a drive fixed to said first drive member and adapted to rotate said first and second drive members said drive further adapted to attach to a portable drill;

wherein said feed element includes an ear which extends over a side wall of said spool and wherein said first gear is fixed to said ear and said ear acts as a guard around an area where said first gear engages said second gear;

whereby rotation of said drive rotates said spool relative to said feed element forcing said metal strip either from said spool or pulling said metal strip back into said spool.

* * * * *